US005562176A

United States Patent [19]

Lucernoni et al.

[11] Patent Number: 5,562,176

[45] Date of Patent: Oct. 8, 1996

[54] MOTOR ARRANGEMENT FOR ROLLER SKATER

[76] Inventors: Fabrizio Lucernoni, Via Ugo de Carolis 99, 00136 Rome, Italy; Giorgio Lazzeri, Via Vespasiano 52, 00192 Rome, Italy

[21] Appl. No.: 160,164

[22] Filed: Dec. 2, 1993

[30] Foreign Application Priority Data

Mar. 17, 1993 [IT] Italy ..... RM93A0169

[51] Int. Cl.[6] ..... A63C 17/12

[52] U.S. Cl. ..... 180/180; 180/19.3

[58] Field of Search ..... 180/180, 19.1, 180/19.2, 19.3; 280/826

[56] References Cited

U.S. PATENT DOCUMENTS

| | | | |
|---|---|---|---|
| 2,027,388 | 1/1936 | Larkin | 280/826 |
| 3,797,446 | 3/1974 | Cox et al. | 180/180 |
| 4,456,089 | 6/1984 | Kuwahara | 180/180 |
| 5,332,058 | 7/1994 | Bianco | 180/180 |

FOREIGN PATENT DOCUMENTS

| | | |
|---|---|---|
| 0572880 | 12/1993 | European Pat. Off. . |
| 1169880 | 1/1959 | France . |
| 3544688 | 6/1987 | Germany . |

*Primary Examiner*—Richard M. Camby

*Attorney, Agent, or Firm*—Watson Cole Stevens Davis, P.L.L.C.

[57] ABSTRACT

A motor arrangement for a roller skater comprising a frame provided with a prime mover, a pair of tires mounted on a transversal axle connected to the frame, a drive bar integral with such frame and carrying at the fore end the motor controls, and a thrust cross-bar secured to the drive bar and pushing the body of the user seizing such drive bar.

15 Claims, 6 Drawing Sheets

MOTOR ARRANGEMENT FOR ROLLER SKATER

Figure 1:
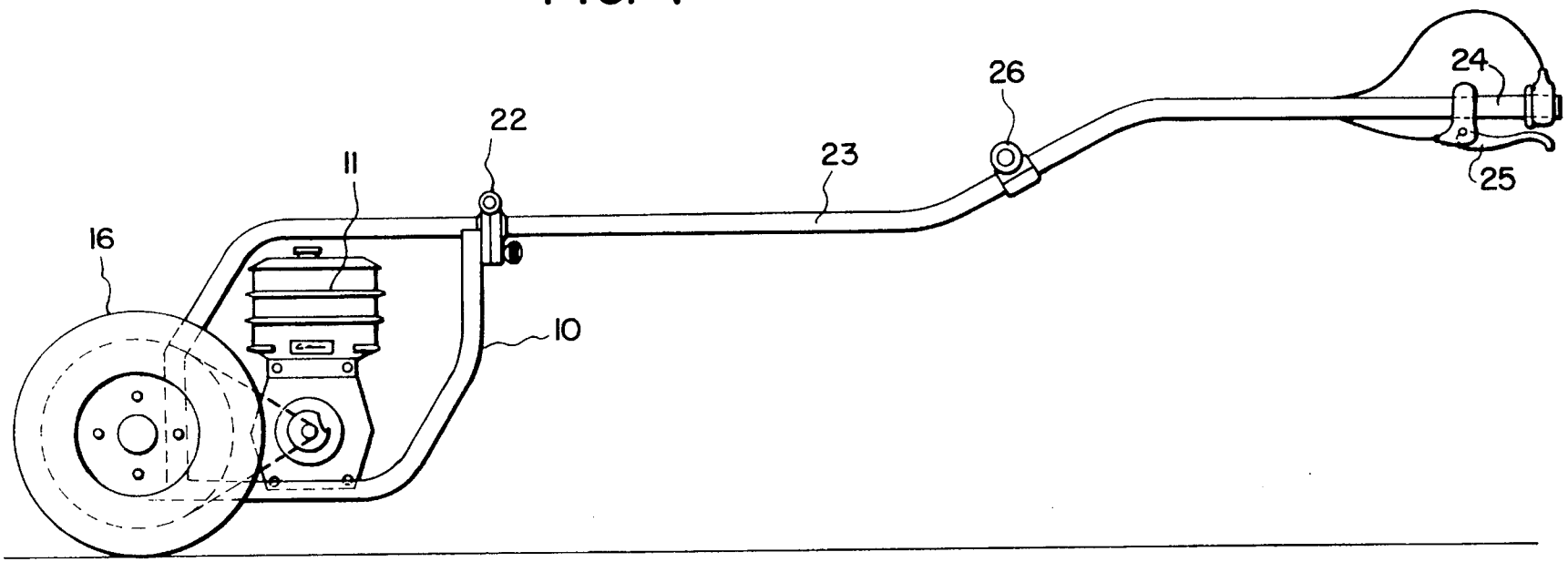

The present invention relates to a motor arrangement for roller skater.

The invention seeks to provide a vehicle of the mentioned type having small overall dimensions and low operating cost, and allowing to move quickly, with agility, and without any remarkable muscular effort.

According to the invention the arrangement comprises a frame on which an explosion engine and a pair of tires are mounted, a drive bar carrying at the fore end a handle provided with the control means of said engine, and a cross-bar located at an intermediate position of said drive bar and acting to the skater as thrust means.

Still according to the invention said drive bar can be provided with a saddle instead of the thrust cross-bar so as to allow the skater to sit astride such drive bar while seizing the control handle.

In a further embodiment a handlebar stem provided at the upper end with the engine control means and at the lower end with a third tire is mounted at the fore end of the drive bar.

Figure 2:
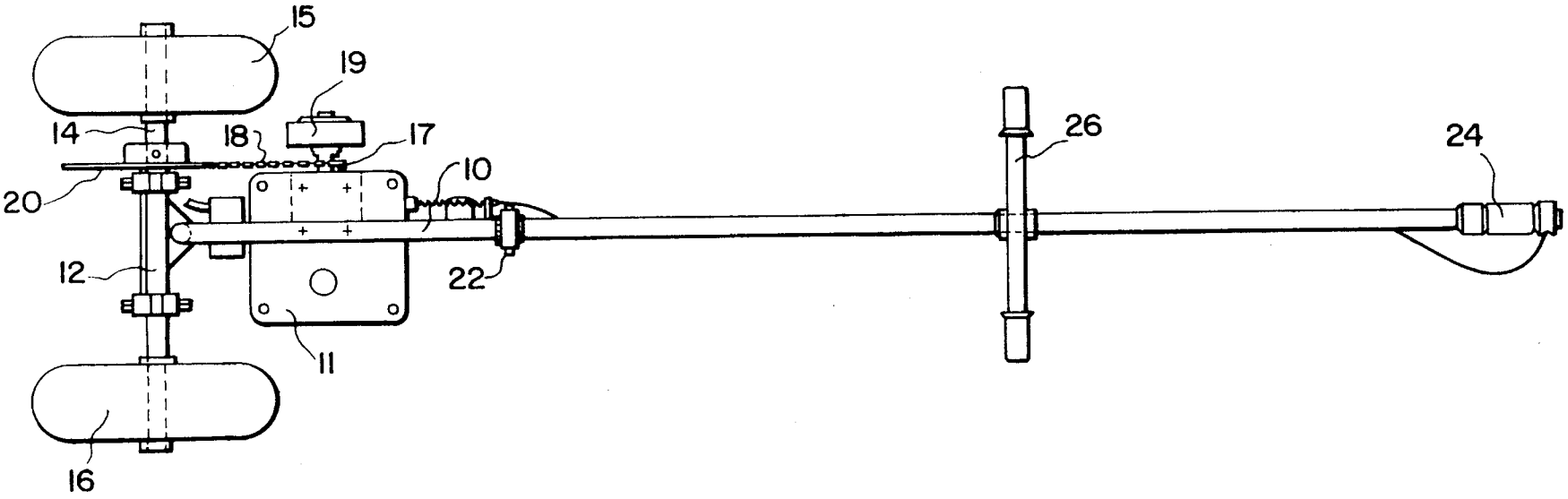
Figure 3:
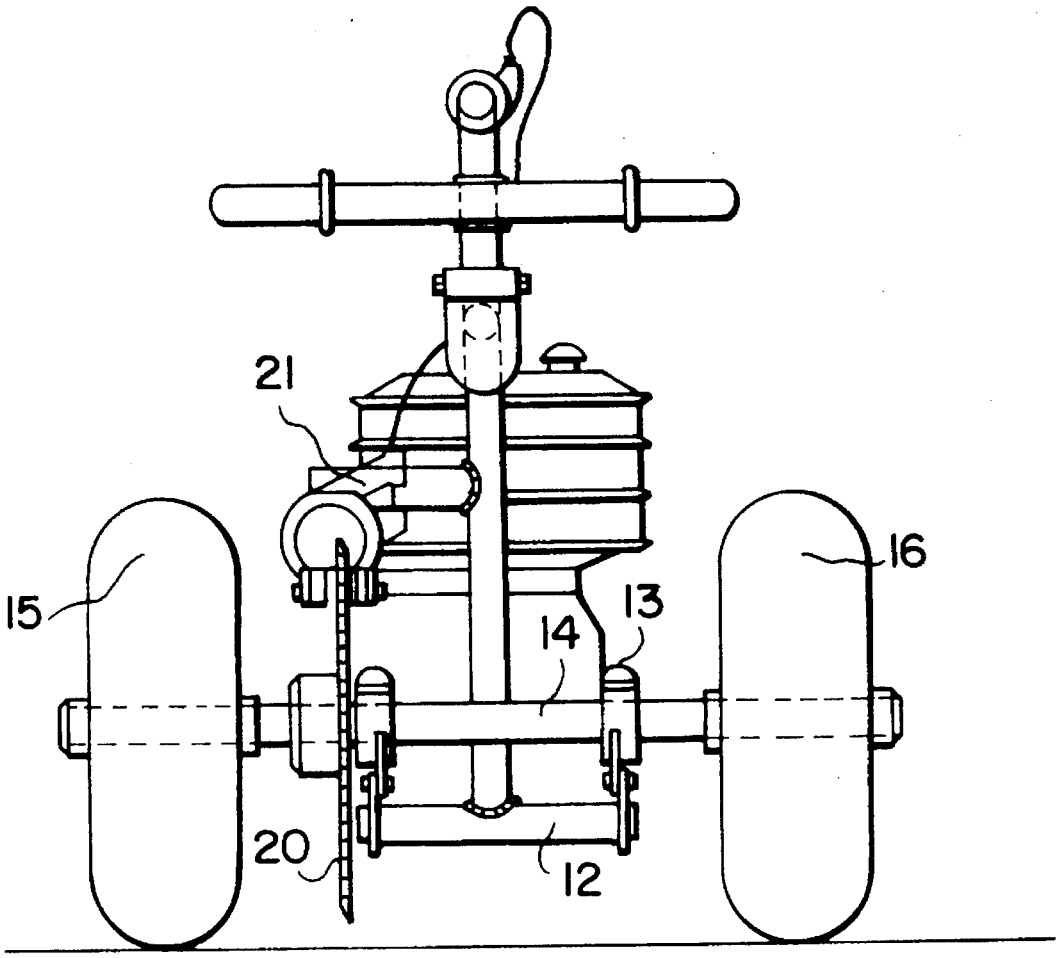
Figure 4A:
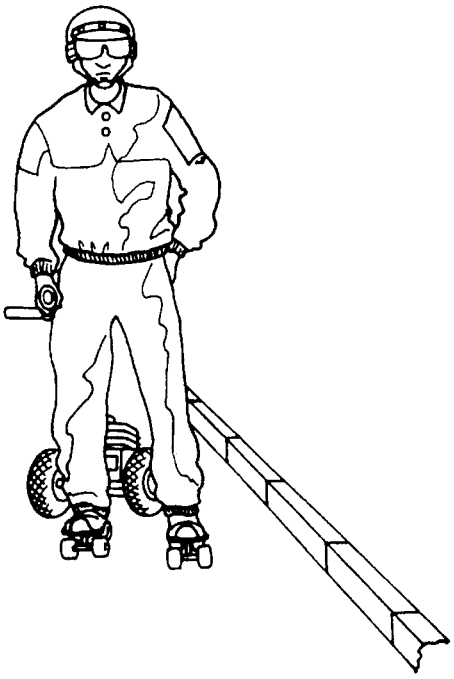
Figure 4B:
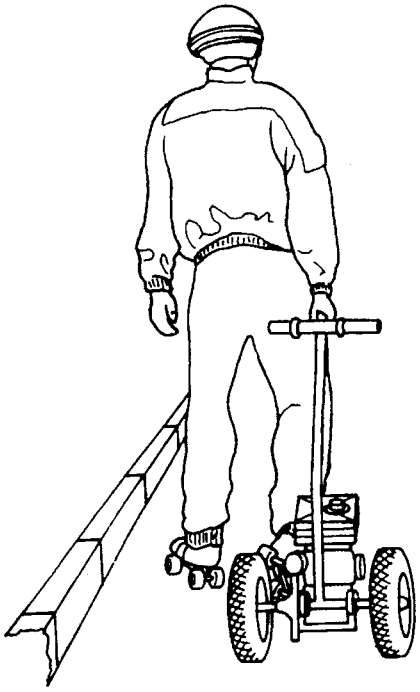
Figure 5A:
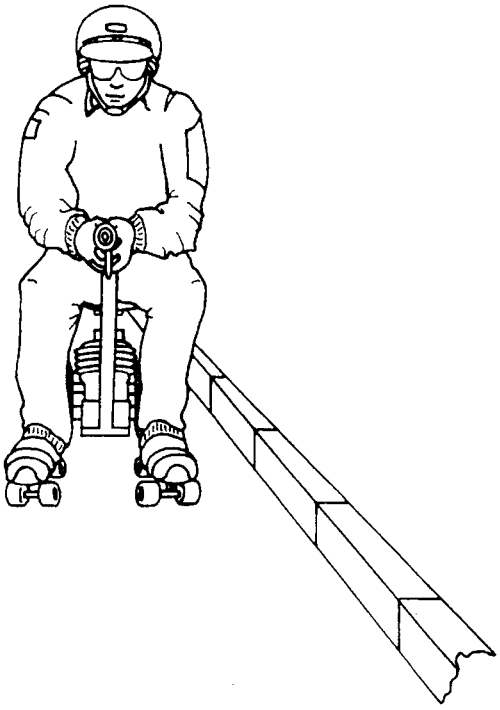
Figure 5B:
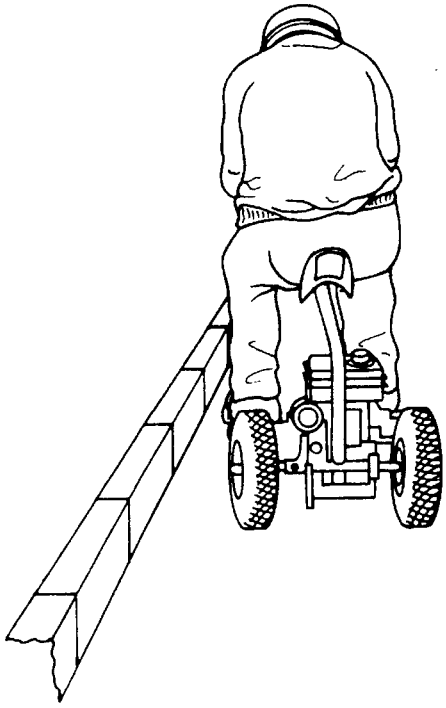
Figure 4:
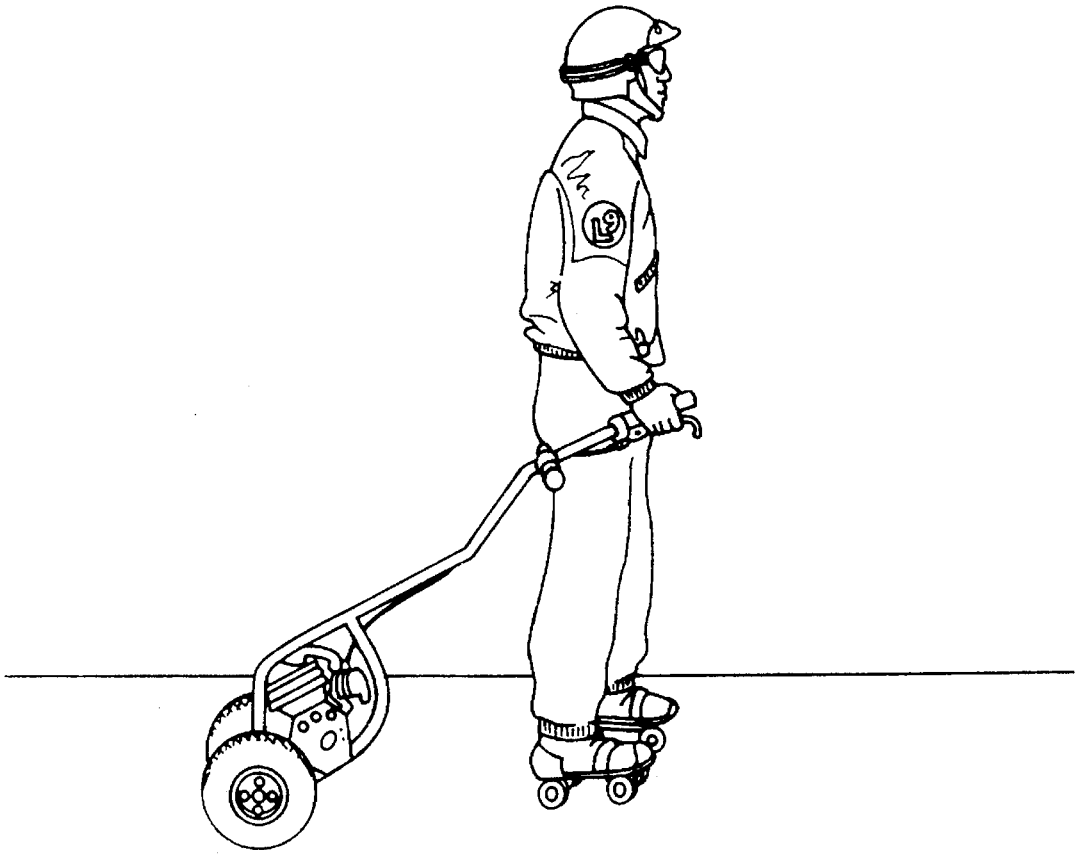
Figure 6:
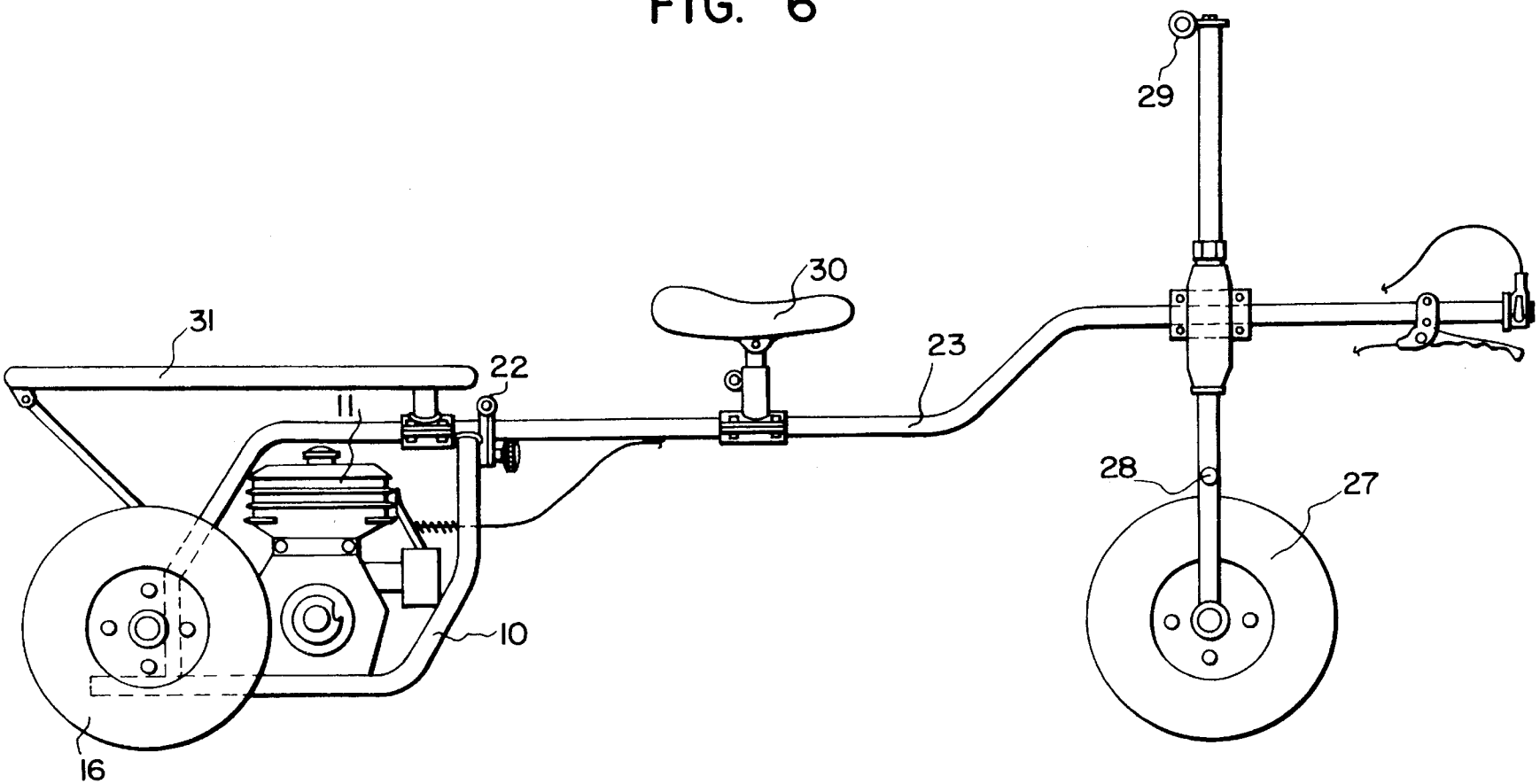

This invention will now be described with reference to the accompanying drawings which show by way of a non-limitative example a preferred embodiment of the invention. In the drawings:

FIG. 1 is a side elevation view of the motor arrangement according to the invention, FIG. 2 shows a top plan view, FIG. 3 is a rear elevation view, FIGS. 4, 4A and 4B show the use of the motor arrangement, FIGS. 5A and 5B show the use of an alternative embodiment provided with saddle, FIG. 6 show a side elevation view of a further three-wheeled embodiment.

With reference to FIGS. 1 to 3 numerals 10 indicates a metal tube frame on which a commercial explosion engine 11 is mounted. Connected to one end of frame 10 is a cross bar 12 carrying at its ends the sockets 13 for supporting the shaft or axle 14 of the two tires 15 and 16. Tire 15 is driven by engine 11 and tire 16 is idle mounted on axle 14 so that the differential gear is not needed.

The drive is a chain gearing and comprises a drive pinion 17 coupled to an automatic centrifugal clutch 18, chain 19, and crown gear 20 splined to the hub of drive wheel 15. A rim brake 21 like that of a bicycle is coupled to said crown gear 20.

In the fore central part of frame 10 there is provided a hinged joint 22 provided with safety lock means and connecting the frame to the drive bar 23 carrying at the fore end the engine control means, i.e. a rotary handle control 24 of the hand accelerator, and a lever 25 of the brake. Such control means are both like those of a motorcycle and are coupled to flexible ropes.

Located at an intermediate position between engine assembly and control means is a cross bar 26 secured to drive bar 23 and provided with hand grips. The position of cross bar 26 can be adjusted by a clamp.

FIGS. 4, 4A and 4B show the use of the motor arrangement with the roller skater in the upright posture. As shown in such figures, the thrust cross bar pushes the rear part of the user's body such as a common ski lift.

In FIGS. 5 and 5A there is shown a bicycle saddle mounted on drive bar 23 and allowing the skater to sit astride such drive bar.

In FIG. 6, in which the same numerals designate the already described parts, there is shown an alternative embodiment of the motor arrangement provided with a third wheel 27 carried by a fork 28 and connected to the handlebar 29. Of course, in such embodiment, the gas and brake controls can be provided on the handlebar as in a conventional motorcycle. There is also provided a saddle 30, a parcel rack 31, and a pair of foot-rails connected to the hub of the fore wheel.

The present invention has been illustrated and described according to a preferred embodiment thereof, however, it should be understood that construction modifications can be made by those skilled in the art without departing from the scope of the present industrial invention. For example, the tires can be replaced by snow or nail wheels for the use of the motor arrangement on roads covered with snow or ice.

We claim:

1. A motor arrangement for a roller skater comprising in combination a frame, a prime mover mounted on said frame, a pair of tires mounted on an axle of said prime mover, a single drive bar hingeably mounted on said frame with a safety lock and means adjustably mounted on said single drive bar for pushing the body of the user.

2. The motor arrangement of claim 1, including a handle provided with motor controls formed of a gas handle and brake lever mounted on said drive bar at the fore free end.

3. The motor arrangement of claim 1, wherein said means is a saddle secured to said drive bar so that the skater can sit astride such drive bar.

4. The motor arrangement of claim 1, wherein the prime mover is a combustion engine driving one wheel while the other wheel is idly mounted on said axle.

5. The motor arrangement of claim 1, wherein said prime mover has a drive between the engine and the driven wheel, said drive being a chain gearing including a pinion and a crown gear to which a rim brake is coupled.

6. The motor arrangement of claim 2, wherein said means is a saddle so that the skater can sit astride such drive bar.

7. The motor arrangement of claim 2, wherein the prime mover is a combustion engine driving one wheel while the other wheel is idly mounted on said axle.

8. The motor arrangement of claim 3, wherein the prime mover is a combustion engine driving one wheel while the other wheel is idly mounted on said axle.

9. The motor arrangement of claim 2, wherein said prime mover has a drive between the engine and the driven wheel, said drive being a chain gearing including a pinion and a crown gear to which a rim brake is coupled.

10. The motor arrangement of claim 3, wherein said prime mover has a drive between the engine and the driven wheel, said drive being a chain gearing including a pinion and a crown gear to which a rim brake is coupled.

11. The motor arrangement of claim 4 wherein said prime mover has a drive between the engine and the driven wheel, said drive being a chain gearing including a pinion and a crown gear to which a rim brake is coupled.

12. A motor arrangement for a roller skater comprising in combination a frame, a prime mover mounted on said frame, a pair of tires mounted on an axle of said prime mover, a single drive bar hingeably mounted on said frame with a safety lock and a cross bar adjustably mounted on said single drive bar for pushing the body of the user.

13. The motor arrangement of claim 12 including a saddle secured to said drive bar so that the skater can sit astride such drive bar.

14. The motor arrangement of claim 12, wherein the prime mover is a combustion engine driving one wheel while the other wheel is idly mounted on said axle.

15. The motor arrangement of claim 12 wherein said prime mover has a drive between the engine and the driven wheel, said drive being a chain gearing including a pinion and a crown gear to which a rim brake is coupled.

* * * * *